US008353507B2

(12) United States Patent
Chihara et al.

(10) Patent No.: US 8,353,507 B2
(45) Date of Patent: Jan. 15, 2013

(54) SHEET FEEDING DEVICE

(75) Inventors: Hiroshi Chihara, Suntou-gun (JP); Atsuya Takahashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/914,372

(22) Filed: Oct. 28, 2010

(65) Prior Publication Data

US 2011/0101600 A1 May 5, 2011

Related U.S. Application Data

(63) Continuation of application No. PCT/JP2009/068603, filed on Oct. 29, 2009.

(51) Int. Cl.
*B65H 1/18* (2006.01)

(52) U.S. Cl. ..... 271/152; 271/153; 271/154; 271/155; 271/156

(58) Field of Classification Search ..... 271/152–156
See application file for complete search history.

(56) References Cited

U.S. PATENT DOCUMENTS 6,032,944 A * 3/2000 Lee ..... 271/110
7,052,007 B2 * 5/2006 Yang et al. ..... 271/10.02

FOREIGN PATENT DOCUMENTS

| | | | |
|---|---|---|---|
| JP | 01313223 | A | * 12/1989 |
| JP | 5-32354 | A | 2/1993 |
| JP | 05186063 | A | * 7/1993 |
| JP | 10-161376 | A | 6/1998 |
| JP | 11334935 | A | * 12/1999 |
| JP | 2002-255369 | A | 9/2002 |
| JP | 2005-255269 | A | 9/2005 |
| JP | 2008-207926 | A | 9/2008 |
| JP | 2009-203047 | A | 9/2009 |

* cited by examiner

*Primary Examiner* — Luis A Gonzalez
(74) *Attorney, Agent, or Firm* — Canon USA Inc. IP Division

(57) ABSTRACT

Occurrence of improper sheet-feeding of sheets is reduced. A sheet stacking section is lifted by an amount that is larger when a sheet-feed retry is performed than when an ordinary lifting operation is performed.

7 Claims, 8 Drawing Sheets

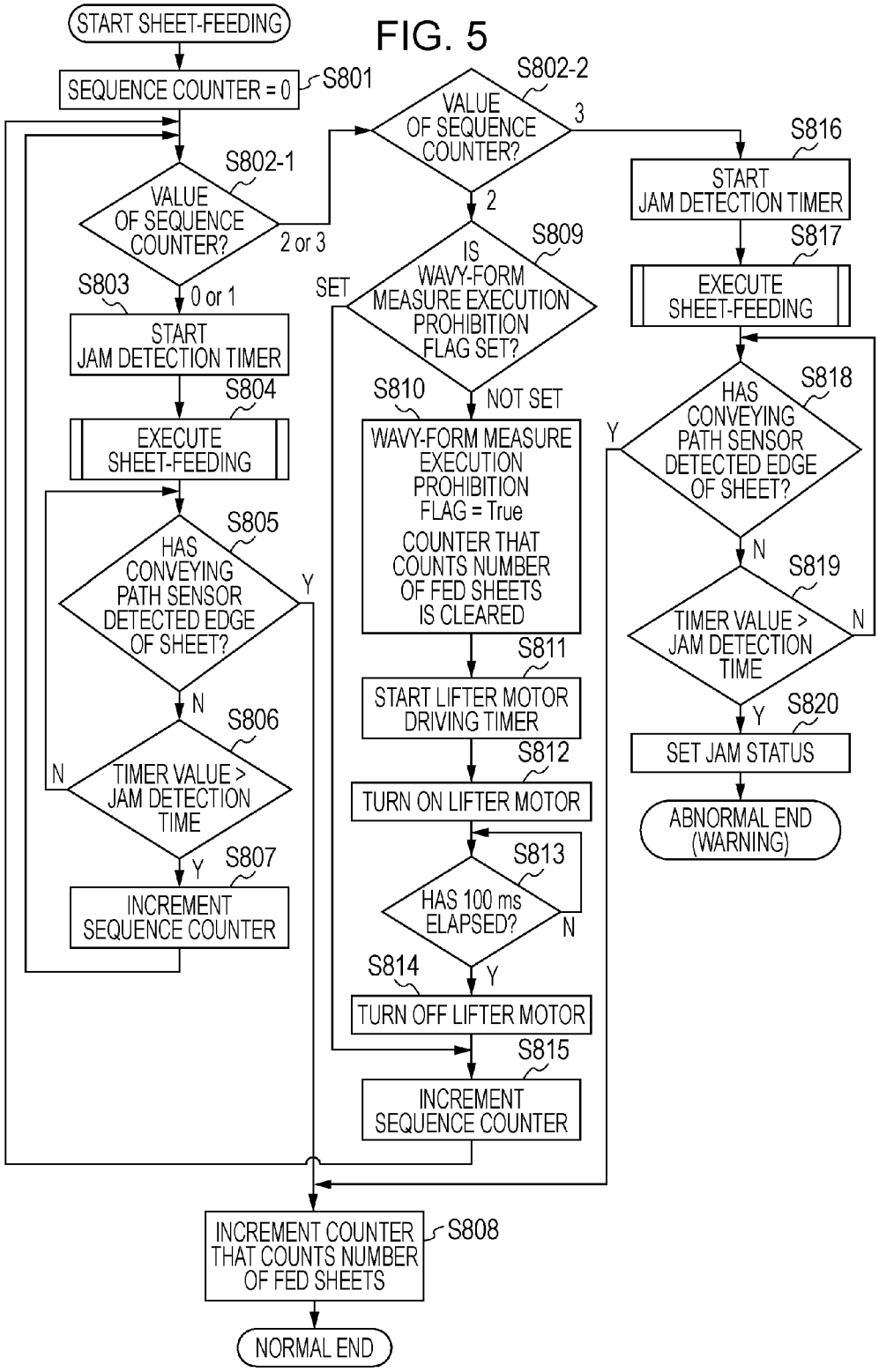
FIG. 5
START SHEET-FEEDING
SEQUENCE COUNTER = 0
S801
S802-1
VALUE OF SEQUENCE COUNTER?
2 or 3
0 or 1
S802-2
VALUE OF SEQUENCE COUNTER?
3
2
S803
START JAM DETECTION TIMER
S804
EXECUTE SHEET-FEEDING
S805
HAS CONVEYING PATH SENSOR DETECTED EDGE OF SHEET?
Y
N
S806
TIMER VALUE > JAM DETECTION TIME
N
Y
S807
INCREMENT SEQUENCE COUNTER
S809
IS WAVY-FORM MEASURE EXECUTION PROHIBITION FLAG SET?
SET
NOT SET
S810
WAVY-FORM MEASURE EXECUTION PROHIBITION FLAG = True
COUNTER THAT COUNTS NUMBER OF FED SHEETS IS CLEARED
S811
START LIFTER MOTOR DRIVING TIMER
S812
TURN ON LIFTER MOTOR
S813
HAS 100 ms ELAPSED?
N
Y
S814
TURN OFF LIFTER MOTOR
S815
INCREMENT SEQUENCE COUNTER
S816
START JAM DETECTION TIMER
S817
EXECUTE SHEET-FEEDING
S818
HAS CONVEYING PATH SENSOR DETECTED EDGE OF SHEET?
Y
N
S819
TIMER VALUE > JAM DETECTION TIME
N
Y
S820
SET JAM STATUS
ABNORMAL END (WARNING)
INCREMENT COUNTER THAT COUNTS NUMBER OF FED SHEETS
S808
NORMAL END

FIG. 7A

| ENVIRONMENT (TEMPERATURE/HUMIDITY) | DRIVING TIME (msec) |
|---|---|
| HIGH TEMPERATURE/ HIGH HUMIDITY | 100 |
| ORDINARY TEMPERATURE/ ORDINARY HUMIDITY | 50 |
| LOW TEMPERATURE/ LOW HUMIDITY | NOT DRIVEN |

FIG. 7B

| TYPE (THICKNESS) OF SHEET S | DRIVING TIME (msec) |
|---|---|
| THIN SHEET | 120 |
| ORDINARY SHEET | 100 |
| THICK SHEET | 80 |

FIG. 7C

| | THIN SHEET | ORDINARY SHEET | THICK SHEET |
|---|---|---|---|
| HIGH TEMPERATURE/ HIGH HUMIDITY | 110 | 100 | 90 |
| ORDINARY TEMPERATURE/ ORDINARY HUMIDITY | 70 | 50 | 40 |
| LOW TEMPERATURE/ LOW HUMIDITY | NOT DRIVEN | NOT DRIVEN | NOT DRIVEN |

SHEET FEEDING DEVICE

This application is a Continuation of International Application No. PCT/JP2009/068603, filed Oct. 29, 2009, which is hereby incorporated by reference herein in its entirety.

TECHNICAL FIELD

The present invention relates to a sheet feeding device that feeds sheets to an image forming apparatus.

BACKGROUND ART

FIG. 8 shows a state in which sheets S are stacked in a sheet cassette serving as a sheet holding section of an image forming apparatus. FIG. 8 shows the interior of the sheet cassette from a side where the sheets S are fed. First, in FIG. 8A, an intermediate plate 401 on which the sheets S are stacked is provided in the sheet cassette, and the sheets S stacked on the intermediate plate 401 are regulated and held by side regulation plates 204 and 205. The side regulation plate 205 is movable in the direction of an illustrated arrow A, and regulates and aligns the sheets S in accordance with the size of the sheets S in a direction orthogonal to a conveying direction of the sheets S (also referred to as a widthwise direction of the sheets S). In addition, a leaf spring 206 for applying a predetermined pressure to the sheets S is provided at the side regulation plate 205 to regulate the sheets S. Further, at a side opposite to a side towards which the sheets are conveyed, the sheets S are also regulated and held by a rear-edge regulation plate, which is movable in accordance with the size of the sheets S.

The stacked sheets S are picked up by a pickup roller 103 and are fed into the image forming apparatus. If a predetermined number of sheets S is fed, and a sheet S is no longer detected by a sheet-surface sensor 104 that detects a topmost surface of the sheets S, the intermediate plate 401 is lifted up in the direction of arrow B until a sheet is detected by the sheet-surface sensor. Accordingly, while repeatedly picking up the sheets S and lifting up the intermediate plate 401, the sheets S are supplied. According to Patent Document 1, a stepping motor for lifting up stacked sheets S is used to repeat a lifting-up operation in accordance with the number of picked up sheets.

Further, in such a sheet cassette, the sheets S may not be properly fed even if the sheets S are picked up by the pickup roller 103. In such a case, the picking-up operation by the pickup roller 103 is repeatedly executed again to also perform control for reducing the occurrence of improper sheet-feeding (also called "sheet-feed retry control"). Patent Document 2 discusses a technology that reduces the occurrence of unsuccessful sheet-feeding by executing a picking-up operation again when a sheet S is unsuccessfully fed by a pickup roller.

In such a sheet cassette, when the environment in which the sheet cassette is used is a high-temperature and high-humidity environment, the sheets S absorb moisture, thereby reducing the toughness of the sheets. The sheets may become flexed or wavy by pressure of the side regulation plate 205. An example in which the sheets are wavy is shown in FIG. 8B. Accordingly, if the sheets absorb moisture and become wavy, a height of the sheets S opposing the pickup roller 103 (height indicated by an auxiliary line 1) is less than a height of the sheets at a position where the sheet-surface sensor 104 performs detection (height indicated by an auxiliary line 2), thereby producing a height difference (h). As mentioned above, on the basis of a detection result of the sheet-surface sensor 104, the intermediate plate 401 is lifted up to control the height of the sheets S. Therefore, when the sheets are wavy, pressure generated by contacting the pickup roller 103 with the sheets S is reduced, thereby causing an improper pickup operation.

To reduce the waviness of the sheets S, for example, the pressure of the side regulation plate 205 may be reduced. However, if the pressure of the side regulation plate 205 is reduced, the degree of alignment of the sheets S in the cassette is reduced. If the degree of alignment is reduced, the sheets S may be obliquely fed. If the sheets S are obliquely fed, improper sheet-feeding results. Therefore, this method of reducing the waviness of the sheets does not satisfactorily solve the problem.

The present invention is achieved for solving the aforementioned problems, and its object is to make it possible to reduce the occurrence of improper sheet-feeding when sheets are fed.

CITATION LIST

Patent Literature

PTL 1 Japanese Patent Laid-Open No. 10-161376
PTL 2 Japanese Patent Laid-Open No. 5-32354

SUMMARY OF INVENTION

A sheet feeding device for solving the aforementioned problems includes a stacking section configured to stack sheets thereat, a sheet feeding section configured to feed the sheet stacked at the stacking section, a sensor configured to detect the sheet stacked on the stacking section, an adjusting section configured to adjust a height of the sheets stacked at the stacking section by lifting the stacking section on the basis of a detection result of the sensor; and a control section configured to control the adjusting section to lift the stacking section by a predetermined amount and thereafter control the sheet feeding section to perform an operation to feed the sheet again, in a case where the sheet are not fed even if the sheet feeding section performs the operation to feed the sheet, wherein the control section sets a number of times for the adjusting section to lift the stacking section by the predetermined amount.

Further features of the present invention will become apparent from the following description of exemplary embodiments with reference to the attached drawings.

BRIEF DESCRIPTION OF DRAWINGS

FIG. 5 is a flowchart of control of driving of a lifter motor according to a first embodiment.

FIGS. 7A to 7C show examples of setting driving times according to second, third, and other embodiments.

DESCRIPTION OF EMBODIMENTS

Embodiments of the present invention will hereunder be described in detail with reference to the drawings. Structural elements discussed in the embodiments are merely examples, and do not limit the scope of the present invention.

First Embodiment

First, an image forming apparatus and a sheet feeding section to which the embodiment is applied will be described.

Figure 1:
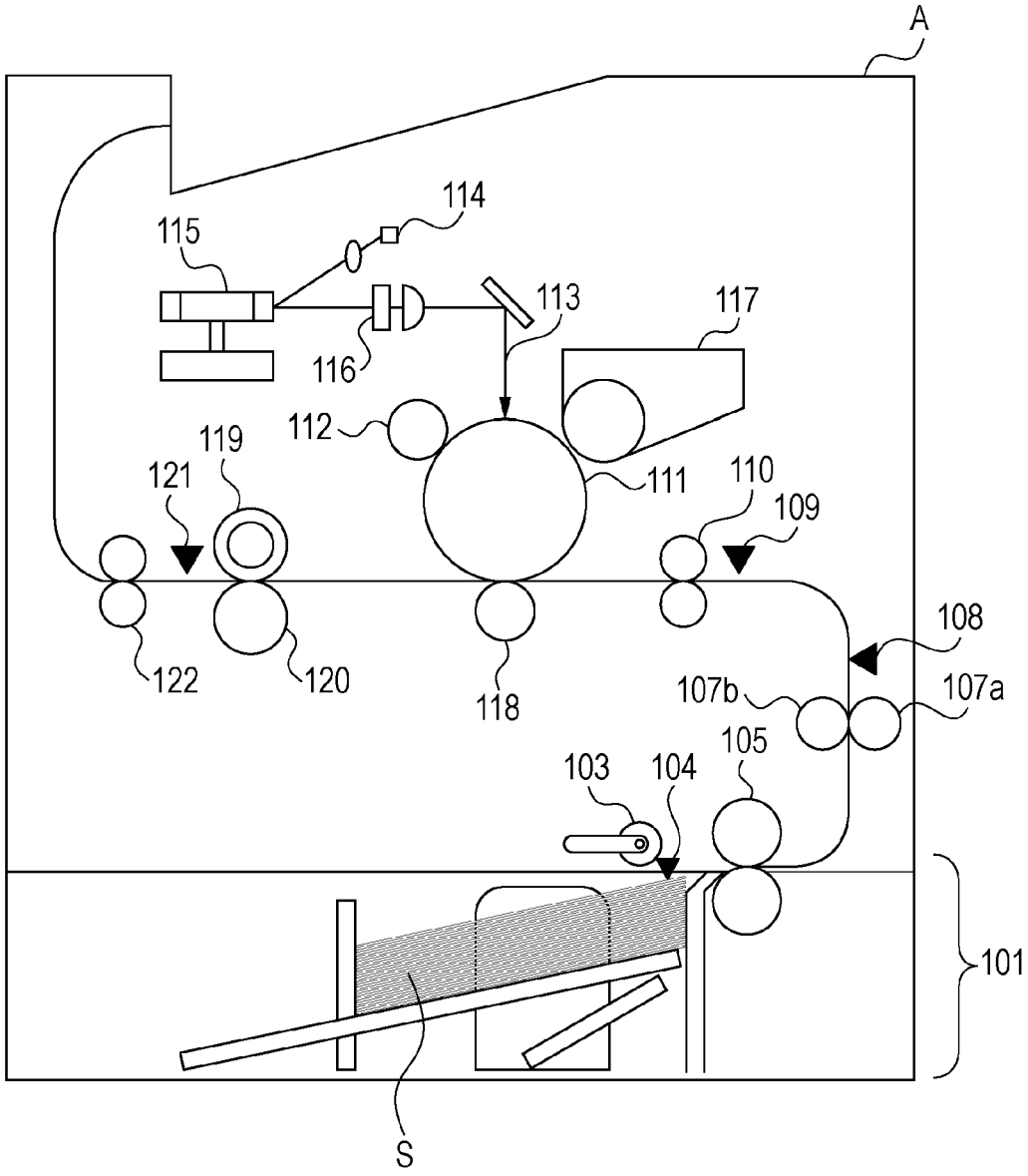
FIG. 1 shows a schematic structure of an image forming apparatus including a sheet feeding section.

FIG. 1 shows a schematic structure of a laser beam printer serving as an image forming apparatus. FIG. 2 shows the structure of a sheet cassette mounted to the image forming apparatus and serving as a sheet feeding section.

In FIG. 1, an image forming section of the laser beam printer A includes a photosensitive drum 111 that serves as an image bearing member on which a developer image is formed; a charging roller 112 that contacts the photosensitive drum 111 and whose surface is uniformly charged; a semiconductor laser 114 that serves as a light-emitting section that irradiates the photosensitive drum 111 with a light beam 113; an optical section including a lens 116 and a scanner 115 that scans the surface of the photosensitive drum 111 with the light beam 113, and a developing section 117 that forms a latent image formed on the photosensitive drum by the optical section into a developer image using a developer (toner). In addition, the image forming section includes a transfer roller 118 and a fixing unit. The transfer roller 118 transfer the developer image formed on the photosensitive drum onto a sheet S picked up from the sheet feeding section 101 and conveyed by sheet-feed rollers 105, a pair of conveying rollers 107*a* and 107*b*, and conveying rollers 110. The fixing unit fixes the developer image transferred onto the sheet S to the sheet S. The fixing unit includes a fixing roller 119 and a pressure roller 120. The fixing roller 119 includes a heater (not shown) that heats the sheet S and the developer image. The pressure roller 120 is disposed so as to press-contact the fixing roller 119. The sheet S onto which the developer image has been transferred is pressed and heated at a press-contact section (also called a "nip portion") formed at the fixing roller 119 and the pressure roller 120, to fix the developer image to the sheet S. The sheet S to which the developer image has been fixed is conveyed by sheet-discharge rollers 112, and is discharged to the outside of the device. Further, a sensor 108 is a sensor that detects a sheet supplied from the sheet feeding section. If a sheet S is not detected within a predetermined time from when a sheet S has been fed, the aforementioned sheet-feed retry control is executed. In addition, a sensor 109 is a sensor for controlling a timing of conveyance of the sheet S by the rollers 110 for transferring the image formed on the photosensitive drum 111 onto a predetermined location of the conveyed sheet S. In addition, a sensor 121 is a sensor that detects the sheet S after fixing the developer image, and that checks whether or not sheet discharge is properly performed. Detection operations of these sensors are well known, and will not be described in detail. Further, in FIG. 1, reference numeral 103 denotes the aforementioned pickup roller, and reference numeral 104 denotes a sheet-surface sensor. In the embodiment, the sheet-surface sensor 104 is a sensor including a flag that contacts sheets S that are stacked and a photo-interrupter that detects a flag operation. Further, the sheet-surface sensor is not limited to a sensor using a flag, so that sensors that indirectly detect the height of the sheets S that are stacked with, for example, ultrasonic waves or light may also be used.

Figure 2A:
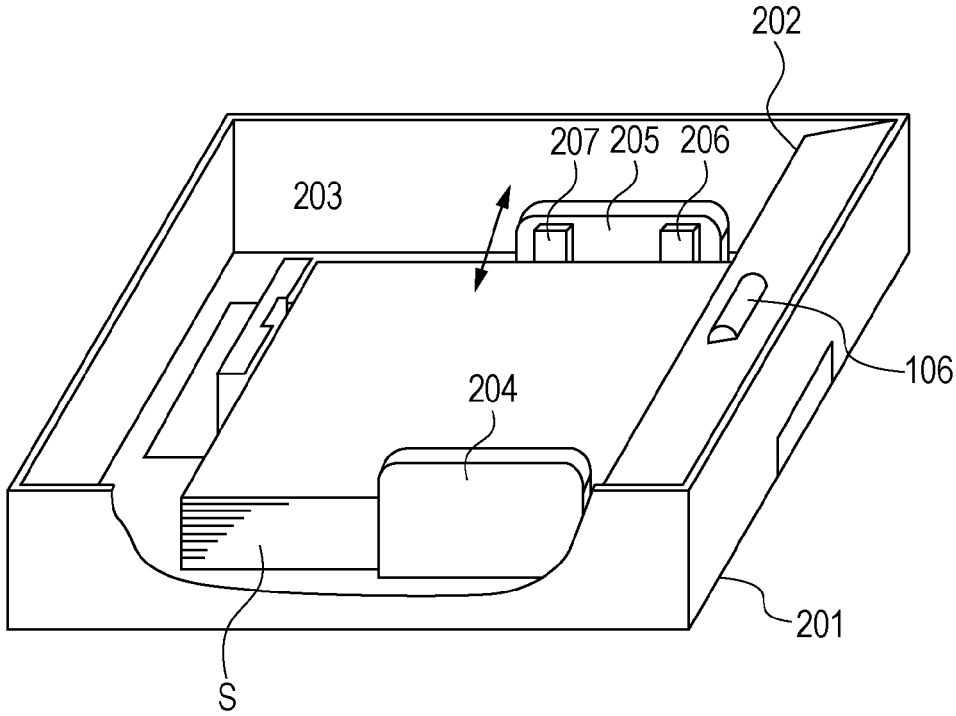
FIGS. 2A and 2B show the structure of the sheet feeding section.
Figure 2B:
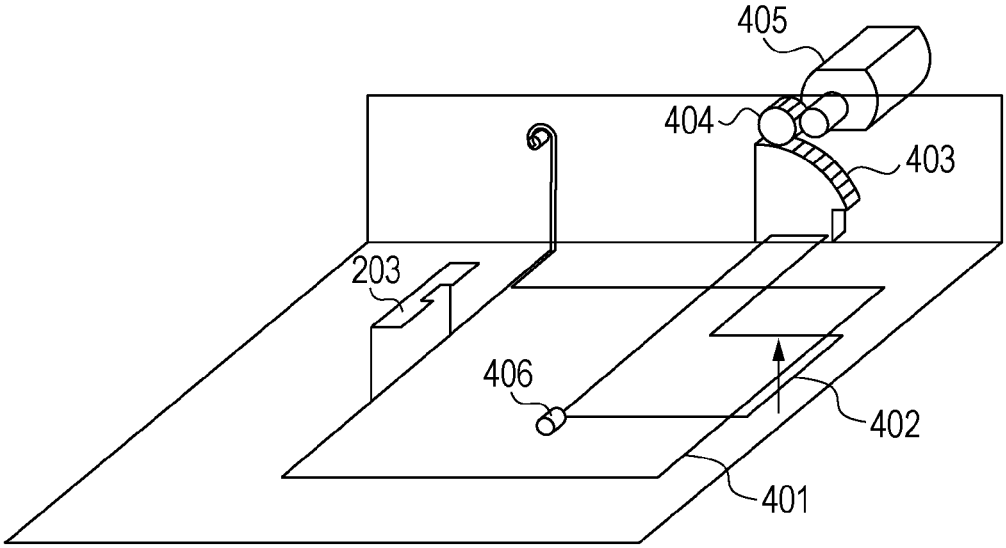

Next, the sheet feeding section 101 (FIG. 1) that feeds sheets S to the image forming section will be described with reference to FIG. 2. FIG. 2A is a perspective view of the sheet cassette 201. The sheet feeding section 101 includes the sheet cassette 201 that holds the sheets S, the pickup roller 103 (see FIG. 1) serving as a sheet feeding section that sends out the sheets S from the sheet cassette 201, the sheet-feed rollers 105 (see FIG. 1) that feed the sheets S, and a separation roller 106. As shown in FIG. 2B, an intermediate plate 401, serving as a stacking section where the sheets S are stacked, is rotatably provided at the sheet cassette 201. At a side towards which the sheets S are fed (the side of the illustrated separation roller 106), the sheets S stacked on the intermediate plate 401 strike a wall surface 202 of the sheet cassette 201. Rear edges of the sheets S at the opposite side strike a rear-edge regulation plate 203 that is movable in accordance with the size of the sheets S. In addition, in a direction orthogonal to a conveying direction of the sheets S (widthwise direction of the sheets S), side regulation plates 204 and 205 are provided. The side regulation plate 205 is movable in the directions of an illustrated double-headed arrow in accordance with the size of the sheets S. Accordingly, the sheets S are stacked while being aligned and held by the rear-edge regulation plate 203 and the side regulation plates 204 and 205. In addition, for aligning the sheets S, leaf springs 206 and 207 that apply pressure towards the center of the sheets S in the widthwise direction are provided at the side regulation plate 205. Further, the pressure of the leaf springs is set by considering the size and type of the sheets that are stacked in the sheet cassette and by previously experimentally determining proper values.

When the sheets S in the sheet cassette 201 are stacked, and the sheet cassette 201 is mounted to the laser beam printer A, as shown in FIG. 2B, a gear 404 of the sheet cassette 201 engages a lifter motor 405 provided at a side of the laser beam printer A. The gear 404 engages a gear 403. When the gear 404 is rotated by the lifter motor 405, the gear 403 is rotated, so that an intermediate plate supporting plate 402, supported by a roller 406, is lifted upward in the direction of an illustrated arrow, to lift the intermediate plate 402 upward.

In addition, as mentioned above, for adjusting the height of the topmost surface of the sheets S that are stacked to a height that is suitable for a sheet feeding operation, the sheet-surface sensor 104 (see FIG. 1) that detects the height of the sheets S is provided. In addition, the pickup roller 103 (see FIG. 1) for picking up the sheets S is provided. Further, this suitable height corresponds to a height that allows contact of the pickup roller 103 and the sheet S at a pressure required for picking up the sheet S, and is previously experimentally determined and set. As mentioned above, when the sheet-surface sensor 104 no longer detects a sheet S, the lifter motor 405 is driven to move the intermediate plate 401 upward. In addition, when a sheet S is detected by the sheet-surface sensor 104, the lifter motor 405 is stopped to adjust the sheet S to the suitable height.

In addition, the sheet feeding section includes the sheet-feed rollers 105, which rotate for sending out picked up sheets S, and the separation roller 106, which is disposed so as to oppose the sheet-feed rollers 105 and which rotates in the direction in which the sheets S are conveyed in the sheet cassette 201. Further, as shown in FIG. 1, the pair of conveying rollers 107*a* and 107*b*, which convey the sheets S, are disposed downstream in the conveying direction from the sheet-feed rollers 105 and the separation roller 106. When a sheet S is fed into the laser beam printer A, first, the pickup roller 103 rotates (moves downward), so that the pickup roller 103 contacts the sheet S with the suitable pressure. Then, the pickup roller 103 rotates to pick up the sheet S, and the sheet S is sent to a conveying section including the sheet-feed rollers 105 and the separation roller 106. Here, the separation roller 106 rotates so as to send the sheet S in a direction opposite to the conveying direction, and only one topmost sheet among the stacked sheets S is separated, and fed to the image forming section of the laser beam printer A through the pair of downstream-side conveying rollers 107*a* and 107*b*. Whether or not the sheet S has been properly fed and conveyed is determined on the basis of whether or not the sensor 108 (see FIG. 1), provided in a conveying path of the laser beam printer A, detects a sheet S within a predetermined time from when sheet-feeding is started (from when the operation of the pickup roller 103 is started). The predetermined time is obtained by adding to a maximum time required for sheet-feeding, the time in which the sheet S is conveyed and a margin time considering conveyance variations and sheet-S size. The predetermined time is previously set on the basis of the length of the conveying path of the device and the conveying speed of sheets S. Then, the conveyed sheet S is conveyed to the registration rollers 110, and is temporarily stopped. In synchronism with an image formed on the photosensitive drum 111, the sheet S is conveyed to a transfer section including the photosensitive drum 111 and the transfer roller, so that the image is transferred onto the sheet S.

Figure 3:
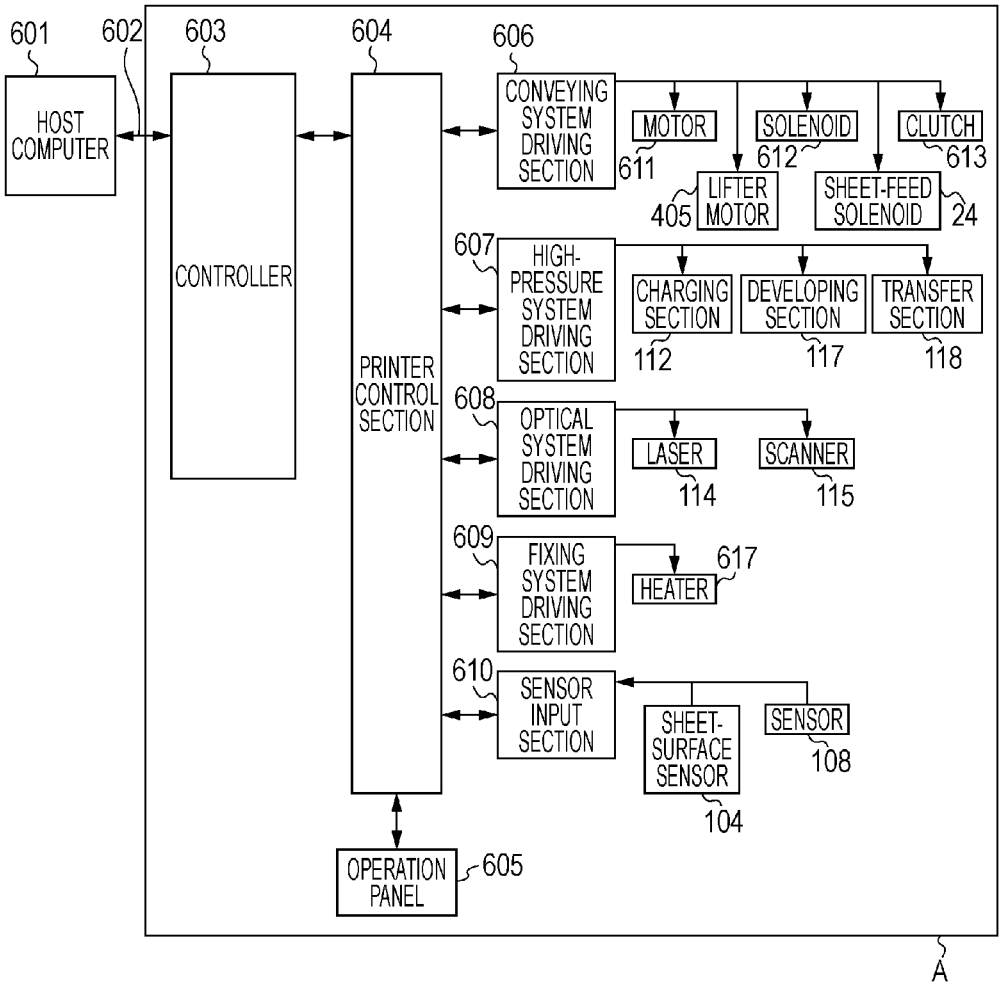
FIG. 3 shows a control section of the image forming apparatus including the sheet feeding section.

Next, a control block and operation in the laser beam printer A will be described with reference to FIG. 3. Reference numeral 601 denotes a host computer connected to the laser beam printer A. Code data of application data including an image and text created from the host computer 601 is transmitted through a communication line 602. The laser beam printer A receives the transmitted code data through a controller 603. The controller 603 analyses the received code data and converts it into bit map data. The controller 603 sends the converted bit map data along with a command to a printer control section 604. In addition, the printer control section 604 executes an image forming operation on the basis of the received command and bit map data. The printer control section 604 sends, for example, status information and a timing signal to the controller 603. The status information is obtained by detecting a state of the image forming section. The timing signal is used for controlling an image forming operation. The controller 603 sends the command and the bit map data to the printer control section 604 in accordance with the status information and the signal sent from the printer control section 604. An operation panel 605 that can be operated by a user to set various modes during image formation is connected to the printer control section 604.

In addition, a conveying system driving section 606, a high-pressure system driving section 607, an optical system driving section 608, a fixing control section 609, and a sensor input section 610 are also connected to the printer control section 604. The conveying system driving section 606 drives/stops various clutches 613, various solenoids 612, and a motor 611 that drives the conveying rollers that convey sheets S. Next, the high-pressure system driving section 607 outputs a high voltage to or stops the charging section (charging roller) 112 that charges the photosensitive drum 111 in the image forming section, the developing section 117 that develops a latent image on the photosensitive drum 111, and the transfer section (transfer roller) 118 that transfers a developer onto a sheet S from the photosensitive drum 111. In addition, the optical system driving section 608 drives/stops the semiconductor laser 114 and the scanner 115. The fixing control section 609 drives/stops the fixing heater 617. Operations of these components are controlled on the basis of an instruction of the printer control section 604. In addition, the sensor input section 610 reads information from various sensors including the sheet-surface sensor 104 and sensors that detect sheets S in other conveying paths, and transmits the information to the printer control section 604. The printer control section controls the operation of the image forming section on the basis of the information from the sensor input section 610.

Next, an operation of feeding sheets from the sheet feeding section in the laser beam printer A will be described on the basis of the above-described control block. First, when a print instruction from the controller 603 is received, the motor 611 is driven to start the sheet feeding operation. In the sheet feeding operation, a topmost sheet S of stacked sheets S is sequentially fed and conveyed. When a plurality of sheets are fed, the height of the topmost surface of the remaining stacked sheets is gradually reduced. Accordingly, in order to maintain the pressure of the pickup roller 103 on the sheets S, it is confirmed whether the sheet-surface sensor 104 is detecting a sheet S every time one sheet is fed. If the sheet-surface sensor 104 no longer detects a sheet S, the lifter motor 405 is driven for a predetermined time. This causes the intermediate plate 401 of the sheet cassette 201 to be lifted upward by a predetermined amount to perform control so that the height of the topmost surface of the sheets S is substantially a certain height. The printer control section 604 functions as an adjusting section that adjusts the height of the sheets. Further, the height of the sheets S that the sheet-surface sensor 104 no longer detects in this case is set to a height at which the pickup roller 103 does not unsuccessfully perform a sheet feeding operation. Even if the sheet-surface sensor 104 no longer detects a sheet S, it is previously set to a height at which sheet-feeding does not become immediately impossible.

In addition, a timing in which the sheet-surface sensor 104 detects a sheet S is set to a timing after passage of a period of time until the pickup roller 103 moves to a position where it contacts a sheet S, with a timing in which the sheet feeding operation is started (in which the operation of the pickup roller 103 is started) serving as a reference. The timing in which the sheet-surface sensor 104 detects a sheet S is a timing in which a maximum time required for the pickup roller 103 to contact a sheet S from the start of the sheet-feeding is considered, and is previously set.

Ordinary drive control of the lifter motor 405 when a plurality of sheets S are continuously fed will be described with reference to the flowchart of FIG. 4. This drive control is executed by the printer control section 604.

Figure 4:
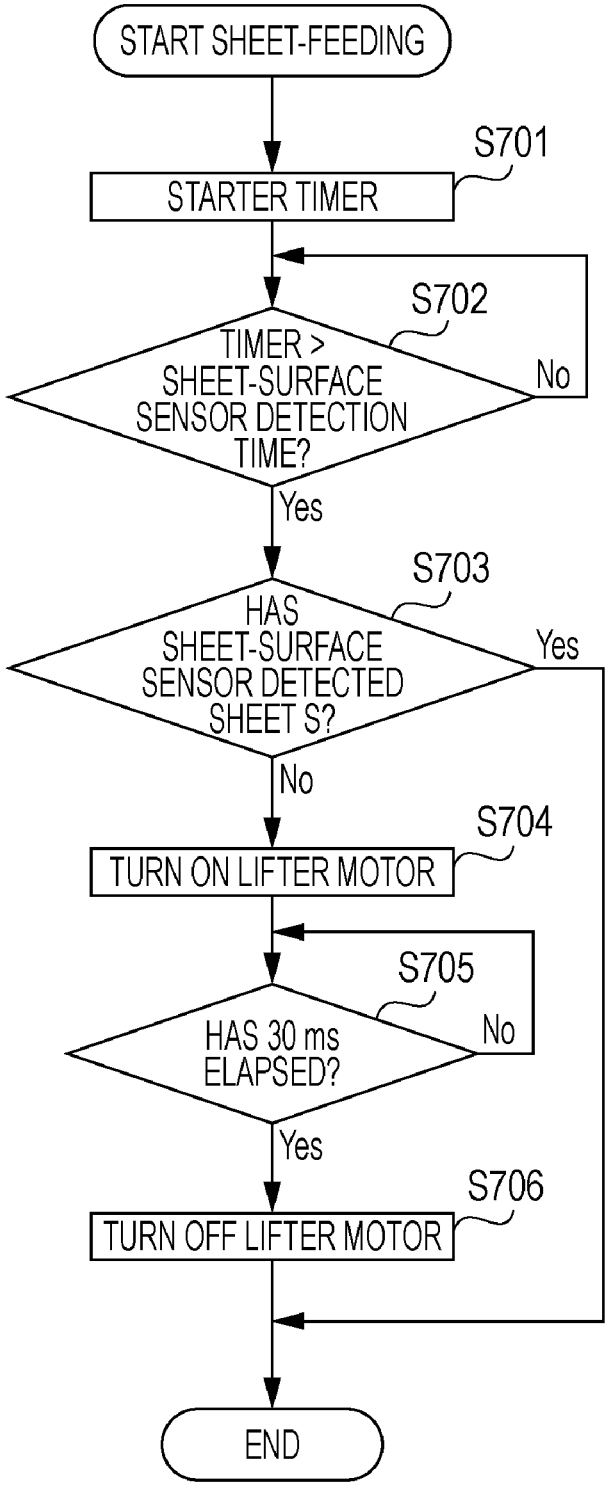
FIG. 4 is a flowchart for ordinary control of driving of a lifter motor.

In FIG. 4, first, sheet-feeding is started to start a timer for determining a detection timing of the sheet-surface sensor 104 (S701). For controlling the height of sheets S, a setting of the detection timing of the sheet-surface sensor 104 is waited for (S702). When the detection timing of the sheet-surface sensor is set, the sheet-surface sensor 104 is checked (S703). A time that is set by the timer for detecting the sheet-surface sensor 104 is set on the basis of the time required for the pickup roller 103 to pick up one sheet S. If a sheet S is not detected by the sheet-surface sensor 104, the lifter motor 405 is driven (S704). Whether or not a driving time of the lifter motor 405 is 30 msec (hereunder "ms") is checked (S705). If the driving time is 30 ms, the lifter motor 405 is stopped (S706). If, in 5703, the sheet-surface sensor 104 detects a sheet S, the process ends without driving the lifter motor 405 (the process proceeds to a next sheet feeding operation).

As shown in FIG. 4, the driving time of the lifter motor 405 is ordinarily 30 ms on the basis of detection results of the sheet-surface sensor 104. When the driving time is 30 ms, an amount by which the intermediate plate 401 is lifted is approximately 0.5 mm. If the sheets S are ordinary sheets, the lifting amount corresponds to approximately three to five sheets. Since the thicknesses of the sheets S differ, the range of from 3 to 5 sheets exists. Therefore, ordinarily, while a plurality of sheets S are being continuously fed and image forming operations are being executed, the lifter motor 405 is driven for 30 ms to adjust the height of the sheets S to a proper height every time three to five sheets S are fed.

However, as mentioned above, when the device is used in a high-temperature and a high-humidity environment, the sheets S become wavy (or flexed). When the sheets S become wavy (or flexed), the height of the sheets S may be lower than the height of the position of the pickup roller 103. In this state, the pressure of the pickup roller 103 on the sheets S is reduced, as a result of which improper sheet-feeding may occur. Therefore, in such a state, further adjustments are required.

In the embodiment, not only is the ordinary lift-up operation illustrated in FIG. 4 performed, but also a special adjusting operation for adjusting the height of the sheets S is executed. Adjustment control in the embodiment will hereunder be described with reference to the flowchart of FIG. 5. The adjustment control is executed by the printer control section 604.

In FIG. 5, when sheet-feeding is started, a sequence counter for determining whether or not the sheet-feeding is repeatedly executed is cleared (S801). The sequence counter is a counter that counts up when sheet-feeding is executed again in the case where a sheet S is not detected by the downstream-side sensor 108 (see FIG. 1) after a predetermined time has elapsed even when the sheet-feeding is executed. The counter is provided at the printer control section 604. The re-execution of the sheet-feeding is similar to the aforementioned sheet-feed retry operation. Next, a value of the sequence counter is checked (S802-1). If the count value is 0 or 1, that is, if the retry operation is a first or a second sheet-feed retry operation, the feeding of the sheets S is delayed, and a jam detection timer for determining whether or not improper conveyance has occurred is started (S803). Then, the sheet-feeding is executed (S804), and it is confirmed whether or not the sensor 108 has detected a sheet S (S805). If a sheet S has not been detected, it is confirmed whether or not a time that is set by the jam detection timer has elapsed (S806). This time is obtained by adding to a time required for a sheet S to reach the sensor 108 after starting the sheet-feeding, a margin time including variations in conveyance of the sheet S. This time is previously experimentally determined and set. After the set time has elapsed without detecting any sheet S, the sequence counter is incremented (S807). In contrast, if, in 5805, a sheet S has been detected, a counter (not shown) that counts the number of fed sheets and that is disposed in the printer control section 604 is incremented (S808) to end the sequence. When a sheet S cannot be detected within a time set by the jam detection timer, the sheet-feed retry operation is executed. In the embodiment, the sheet-feed retry operation is set so that it can be executed three times. The number of times the retry operation is executed can be changed on the basis of, for example, the conveying speed of the sheets S and the conveying distance to where an image is transferred after the sheet S is fed. The number of times the retry operation is executed is set on the basis of an image transferable delay time for when the conveyance of the fed sheet S is delayed.

On the other hand, if, in S802-1, the count value of the sequence counter is 2 or 3, the process proceeds to Step S802-2 to determine that the count value of the sequence counter is 2 or 3. If the count value of the sequence counter is 2, it is confirmed whether or not a wavy-form measure execution prohibition flag is set (S809). The wavy-form measure execution prohibition flag is provided for determining whether or not a special drive control operation of the lifter motor 405 (described later) is performed. The wavy-form measure execution prohibition flag is set using a flag memory provided in the printer control section 604. Ordinarily, the wavy-form measure execution prohibition flag is not set, that is, the execution of the special drive control of the lifter motor 405 (described later) is allowed.

Next, if the wavy-form measure execution prohibition flag is not set, the wavy-form measure execution prohibition flag is set, and the counter that counts the number of fed sheets is cleared (S810). Then, a lifter motor driving timer is started (S811), and the lifter motor 405 is driven (S812). The lifter motor driving timer is monitored to wait for the passage of 100 ms (S813). After the passage of 100 ms, the lifter motor 405 is stopped (S814), and the count value of the sequence counter is incremented (S815). If, in S809, the wavy-form measure execution prohibition flag is set, the lifter motor 405 is not driven, and the process proceeds to S815 to increment the count value of the sequence counter from 2 to 3.

In addition, if, in S802-2, the count value of the sequence counter is 3, the jam detection timer is started (S816) as in S803. Then, sheet-feeding is performed (S817), and it is confirmed whether or not the sensor 108 has detected a sheet S (S818). If a sheet S has not been detected, it is confirmed whether or not a predetermined time of the jam detection timer has elapsed (S819). If the predetermined time has passed without a sheet S being detected, it is determined that jamming has occurred, and the printer control section 604 sets a jam status (S820), and the sequence ends. The setting of the jam status refers to an operation in which the printer control section 604 sets a status indicating that a sheet S has been unsuccessfully fed and that the sheet S has been jammed. In this case, the operation is stopped to give a warning that the jam has occurred, and the process ends. That is, in the embodiment, if the sensor 108 does not detect a sheet S even if the sheet-feed retry operation is repeated three times, it is determined that a jam caused by improper sheet-feeding has occurred. If, in 5818, a sheet S is detected, the counter that counts the number of fed sheets is incremented (S808), and the sequence ends.

Here, the ordinary driving of the lifter motor 405 shown in FIG. 4 is executed when a sheet S is not detected by the sheet-surface sensor 104. A driving time in this case is 30 ms for setting the lifting amount of the intermediate plate 401 to an amount corresponding to 0.5 mm. Driving of the lifter motor 405 for taking measures against wavy sheets S is also executed when the sheet-surface sensor 104 detects a sheet surface. A driving time in this case is 100 ms for setting the lifting amount of the intermediate plate 401 to an amount corresponding to 1.5 mm. Accordingly, by lifting the intermediate plate 401 by driving the lifter motor 405 when the sheet-feed retry operation is executed, the pickup roller 103 is pressed against wavy sheets S with the suitable pressure. Even if the sheet-surface sensor 104 is detecting a sheet surface, the lifting operation is executed. This makes it possible to reduce the occurrence of improper feeding of the wavy sheets S. The driving time of 100 ms is set on the basis of the result of previously measuring a degree of waviness of the sheets S in a high-temperature and a high-humidity environment. Although, in the embodiment, the driving time is 100 ms, the time (lifting amount) is set on the basis of a value obtained by previously experimentally inspecting an amount that is in accordance with the wavy or flexed state of the sheets.

Figure 6A:
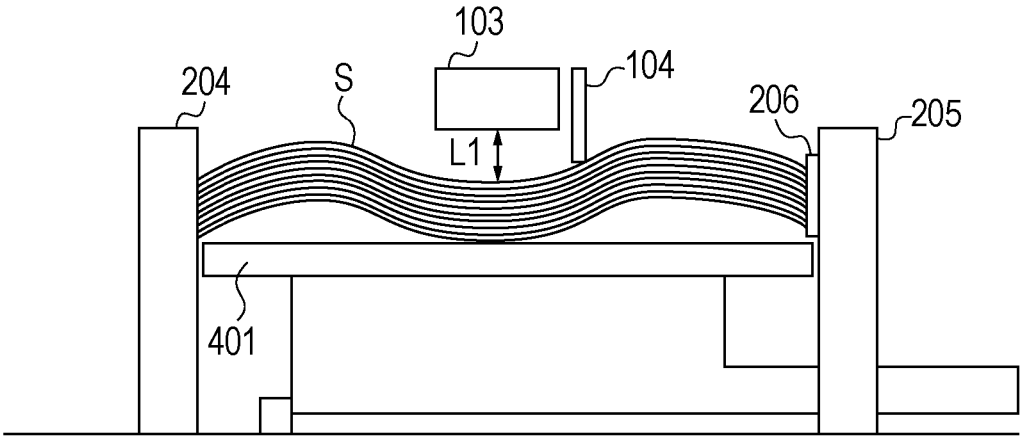
FIGS. 6A and 6B show states of sheets when the drive control according to the first embodiment is performed.
Figure 6B:
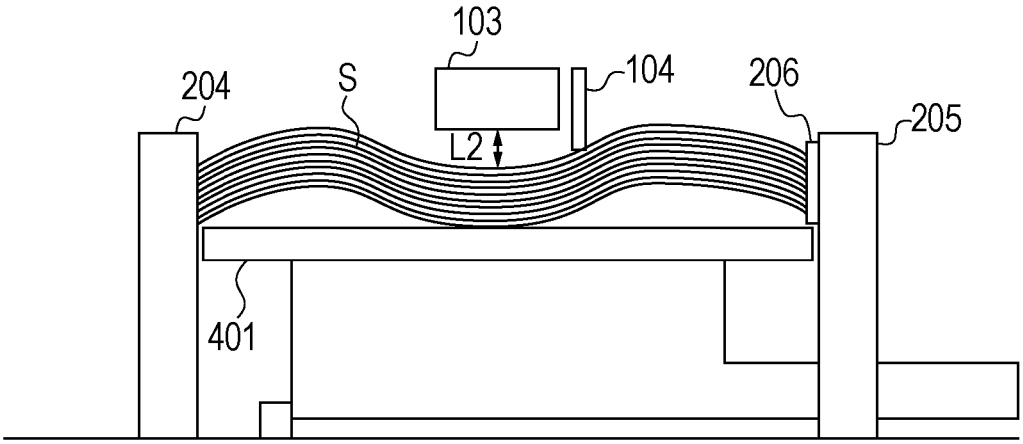
Figure 8A:
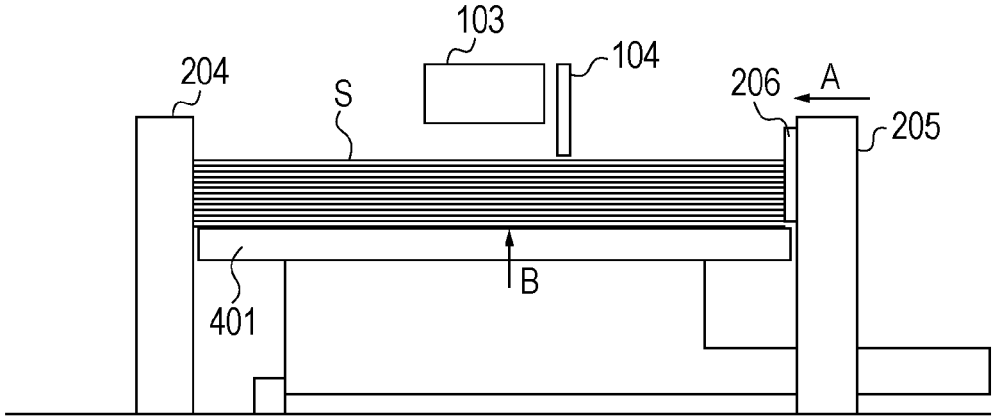
FIGS. 8A and B show states in which sheets are stacked.
Figure 8B:
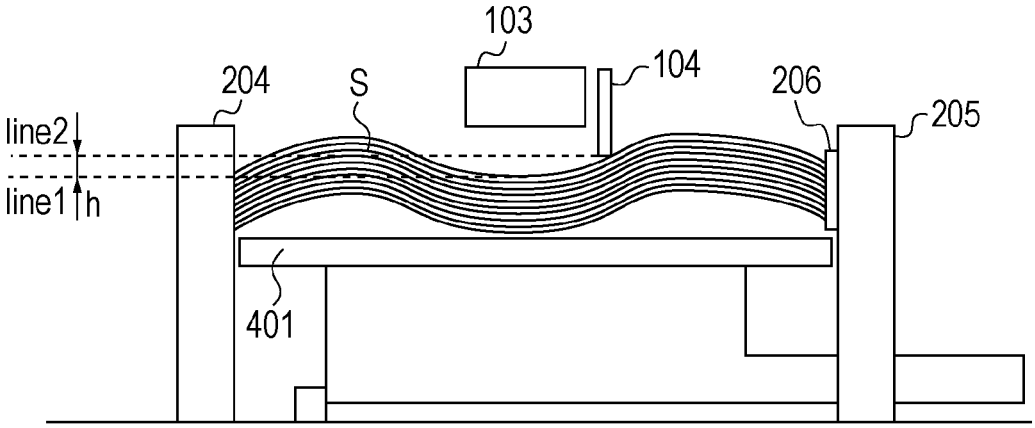

States of the sheets in the sheet cassette 201 when the special adjusting operation illustrated in FIG. 5 is executed are shown in FIG. 6. FIG. 6A is similar to FIG. 8B, and shows an inside state resulting from stacking wavy sheets and executing the special adjusting operation. In this case, the distance between the pickup roller 103 and the sheet S is L1. FIG. 6B shows a state of the sheets S are in the sheet cassette after executing the special drive control. This corresponds to a state after driving the lifter motor for 100 ms after executing the sheet-feed retry operation. Here, the distance between the pickup roller 103 and the sheets S is L2, and L2>L1. Therefore, the pressure of the pickup roller 103 on the sheets S is set to a proper pressure. Structural features of the respective parts in FIG. 6 have already been described above, so that they will not be described below.

In addition, if the special drive control of the lifter motor 405 is repeatedly executed, the height of the sheets S becomes too large. As a result, the pressure of the pickup roller 103 on the sheets S becomes too large, thereby causing improper sheet-feeding and pickup roller failure. Therefore, a limit is set on the number of special drive control operations of the lifter motor 405 that are executed. More specifically, in 5810 in FIG. 5, after the lifter motor 105 is driven for 100 ms once, the wavy-form measure execution prohibition flag is set to limit the number of times that measures are taken against the wavy sheets to one. Further, the conditions for clearing the wavy-form measure execution prohibition flag that have been set are as follows: the sheet-surface sensor 104 no longer detects a sheet S, the value of the counter that counts the number of fed sheets reaches a predetermined value (such as 15 sheets), and it is detected that the sheet cassette 201 is removed from the laser beam printer.

Further, although, according to the flowchart of FIG. 5, the special driving of the lifter motor is executed when the second sheet-feed retry operation is performed, the special driving of the lifter motor need not be performed when the second sheet-feed retry operation is performed. It may be performed in accordance with the number of allowable sheet-feed retry operations.

As described above, when the sheet-feeding is not successfully performed even if the sheet-reed retry operation is executed while continuously feeding the sheets S and adjusting the height of the sheets S during image formation on the basis of the detection result of the sheet-surface sensor, the lifter motor is further driven even if the sheet-surface sensor is detecting a sheet. By executing such drive control, even if the sheets S become wavy due to environmental variations, it is possible to reduce the occurrence of improper sheet-feeding and to execute sheet-feeding.

Second Embodiment

In the first embodiment, the driving time in the special drive control of the lifter motor is fixed at 100 ms. In a second embodiment, the driving time varies in accordance with the environment. The degree of waviness of the sheets S varies in accordance with changes in temperature and humidity. If the driving time is made variable considering the amount of variation, it is possible to set the pressure generated when the pickup roller 103 contacts the sheets S to a suitable pressure. Setting of the driving time in accordance with temperature and humidity will hereunder be described.

In the embodiment, an environmental sensor that detects temperature or humidity is mounted to the laser beam printer A. Using detection results of the environmental sensor, the driving time is variably set. A specific example of variably setting the driving time is given. As shown in FIG. 7A, when a high temperature and a high humidity (30° C. and 85%) are detected by the environmental sensor, the driving time is 100 ms as described in the first embodiment; when ordinary temperature and ordinary humidity (20° C. and 60%) are detected by the environmental sensor, the driving time is 50 ms; and, when a low temperature and a low humidity (15° C. and 20%) are detected by the environmental sensor, the driving is not performed. The temperature and humidity are detected by the environmental sensor prior to starting sheet-feeding and are grasped by the printer control section 604. In addition, these set variable values for the driving are only examples, so that the driving time may be more finely variably set in accordance with temperature and humidity.

Accordingly, the driving time in the special drive control of the lifter motor is switched in accordance with the temperature and humidity detected by the environmental sensor. By this, it is possible to take measures against changes in the degree of waviness of the sheets S occurring in accordance with changes in temperature and humidity, and to set the pressure of the pickup roller on the sheets to a suitable pressure, so that the occurrence of improper sheet-feeding can be reduced.

Third Embodiment

In the second embodiment, the control for switching the driving time in the special drive control of the lifter motor by detecting temperature and humidity is executed. In the third embodiment, the driving time is switched in accordance with the type of sheets that are stacked in the sheet cassette. In particular, the degree of waviness of sheets S at high temperature and high humidity differ depending upon differences in thickness. For example, the relationship between the degrees of waviness of ordinary sheets, thin sheets (which are thinner and less tough than ordinary sheets), and thick sheets (which are thicker and more tough than ordinary sheets) in a high-temperature and high-humidity environment is: the degree of waviness of thin sheets<degree of waviness of ordinary sheets<degree of waviness of thick sheets. Considering this relationship, as shown in FIG. 7B, the driving time is switched in accordance with the type of sheet S.

FIG. 7B shows an example of setting the driving time in accordance with the type of sheet S in a high-temperature and high-humidity environment. When the driving time for ordinary sheets is 100 ms, the driving time for thin sheets is 120 ms, and the driving time for thick sheets is 80 ms. When, on the basis of this setting example, the driving time when executing the special drive control of the lifter motor in the first embodiment is switched, the pressure of the pickup roller 103 on sheets S can be set to a proper pressure in accordance with the type (thickness) of the sheets S. The thickness of the sheets S is set prior to starting sheet-feeding.

Accordingly, it is possible to reduce the occurrence of improper sheet-feeding by setting to a suitable pressure, the pressure of the pickup roller on sheets in accordance with changes in the degrees of waviness of the sheets S according to sheet type.

Other Embodiments

Further, it is possible to set the driving time by combining the switching of the driving time in accordance with changes in temperature and humidity described in the second embodiment with the switching of the driving time in accordance with the type (thickness) of sheets S described in the third embodiment. For example, as shown in FIG. 7C, the driving time may be set in accordance with temperature, humidity, and the type (thickness) of sheets. By this, it is possible to reduce the occurrence of improper sheet-feeding by setting to a suitable pressure, the pressure of the pickup roller 103 on the sheets S in accordance with temperature and humidity and the type of sheets S.

Further, in addition to switching the driving time in accordance with temperature and humidity and switching the driving time in accordance with the type (thickness) of sheets S, the driving time may be switched in accordance with the number of sheets S stacked in the sheet cassette. In this case, since there is a tendency for the degree of waviness of sheet S to increase as the number of sheets S stacked in the sheet cassette decreases, the relationship between the driving times is: driving time when the number of stacked sheets S is large<the driving time when the number of stacked sheets S is small. This makes it possible to reduce the occurrence of improper sheet-feeding by setting to a suitable pressure, the pressure of the pickup roller on sheets S in accordance with the number of stacked sheets S.

As mentioned above, according to the present invention, it is possible to reduce the occurrence of improper sheet-feeding when sheets are fed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

REFERENCE SIGNS LIST

106 separation roller
201 sheet cassette
202 wall surface of sheet cassette
203 rear-edge regulation plate
204, 205 side regulation plate
206, 207 leaf spring
S sheet

The invention claimed is:

1. A sheet feeding device comprising:

a stacking section configured to stack sheets thereat;

a sheet feeding section configured to feed the sheet stacked at the stacking section;

a sensor configured to detect the sheet stacked on the stacking section;

an adjusting section configured to adjust a height of the sheets stacked at the stacking section by lifting the stacking section on the basis of a detection result of the sensor; and a control section configured to control the adjusting section to lift the stacking section by a predetermined amount and thereafter control the sheet feeding section to perform an operation to feed the sheet again, in a case where the sheet is not fed even if the sheet feeding section performs the operation to feed the sheet, wherein the control section sets a number of times for the adjusting section to lift the stacking section by the predetermined amount, and wherein the predetermined amount corresponds to an amount that is in accordance with a state of the sheets that are stacked at the stacking section, and is greater than an amount by which the stacking section is lifted on the basis of the detection result of the sensor.

2. The sheet feeding device according to claim 1, wherein, after lifting the stacking section by the amount that is in accordance with the state of the sheets stacked at the stacking section, the adjusting section prohibits lifting the stacking section.

3. The sheet feeding device according to claim 1, wherein, in accordance with temperature and humidity, the adjusting section switches the amount that is in accordance with the state of the sheets stacked at the stacking section.

4. The sheet feeding device according to claim 1, wherein, in accordance with a thickness of the sheets, the adjusting section switches the amount that is in accordance with the state of the sheets stacked at the stacking section.

5. The sheet feeding device according to claim 1, wherein, in accordance with the number of the sheets stacked at the stacking section, the adjusting section switches the amount that is in accordance with the state of the sheets stacked at the stacking section.

6. The sheet feeding device according to claim 1, wherein, even if the sheets are being detected by the sensor, the adjusting section lifts the stacking section by the amount that is in accordance with the state of the sheets stacked at the stacking section.

7. The sheet feeding device according to claim 1, wherein the amount that is in accordance with the state of the sheets stacked at the stacking section corresponds to an amount that is in accordance with a wavy state or a flexed state of the sheets.

* * * * *